US006152302A

United States Patent [19]

Miller et al.

[11] Patent Number: 6,152,302

[45] Date of Patent: Nov. 28, 2000

[54] CHIP AND DIP TRAY

[75] Inventors: David George Miller, Carrollton; Arie Nissan Sharon, Rowlett, both of Tex.

[73] Assignee: Recot, Inc., Pleasanton, Calif.

[21] Appl. No.: 09/328,159

[22] Filed: Jun. 8, 1999

[51] Int. Cl.[7] ..... A45C 11/20

[52] U.S. Cl. ..... 206/549; 206/564; 229/904; 220/501

[58] Field of Search ..... 206/541, 549, 206/562, 563, 565, 564; 229/904, 902; 426/115, 119, 120; 220/501, 505, 506, 507

[56] References Cited

U.S. PATENT DOCUMENTS

| | | | |
|---|---|---|---|
| D. 166,735 | 5/1952 | Chaplin . | |
| D. 233,581 | 11/1974 | Bridges . | |
| D. 284,157 | 6/1986 | Morr . | |
| D. 335,442 | 5/1993 | Detert et al. . | |
| D. 366,187 | 1/1996 | Van Den Kieboom . | |
| D. 366,828 | 2/1996 | Bachand et al. . | |
| D. 379,301 | 5/1997 | Lippincott . | |
| D. 381,264 | 7/1997 | Lippincott . | |
| D. 386,075 | 11/1997 | Hayes . | |
| D. 393,798 | 4/1998 | Joswick . | |
| D. 398,481 | 9/1998 | Brown . | |
| D. 404,218 | 1/1999 | Sussman . | |
| 2,766,919 | 10/1956 | Randall | 206/562 |
| 2,843,287 | 7/1958 | Finley . | |
| 3,037,677 | 6/1962 | Debs . | |
| 3,651,930 | 3/1972 | Artz . | |
| 3,726,395 | 4/1973 | Duhy . | |
| 4,202,464 | 5/1980 | Mohs et al. . | |
| 4,208,006 | 6/1980 | Bixler et al. | 206/564 |
| 4,219,144 | 8/1980 | Hagelberg | 206/563 |
| 4,286,136 | 8/1981 | Mason, Jr. . | |
| 4,568,017 | 2/1986 | Grunert . | |
| 4,702,368 | 10/1987 | Jones . | |
| 4,722,850 | 2/1988 | White et al. . | |
| 4,781,289 | 11/1988 | Perkins . | |
| 4,961,494 | 10/1990 | Alexander . | |
| 4,962,849 | 10/1990 | Anderson . | |
| 5,011,006 | 4/1991 | Anderson . | |
| 5,096,065 | 3/1992 | Vigue | 206/564 |
| 5,119,940 | 6/1992 | Grindrod . | |
| 5,167,973 | 12/1992 | Snyder . | |
| 5,209,352 | 5/1993 | Light et al. | 206/564 |
| 5,277,920 | 1/1994 | Weaver, Jr. . | |
| 5,350,059 | 9/1994 | Chester et al. | 206/565 |
| 5,375,701 | 12/1994 | Hustad et al. . | |
| 5,381,901 | 1/1995 | Hundley | 206/564 |
| 5,503,858 | 4/1996 | Reskow . | |
| 5,598,944 | 2/1997 | Aragona . | |
| 5,657,873 | 8/1997 | Hustad et al. . | |
| 5,657,874 | 8/1997 | Hustad et al. . | |
| 5,697,512 | 12/1997 | Brickley | 206/566 |
| 5,747,084 | 5/1998 | Cochran et al. . | |
| 5,788,081 | 8/1998 | Bates | 206/562 |
| 5,816,411 | 10/1998 | Smith | 206/782 |
| 5,853,105 | 12/1998 | Roman et al. . | |
| 5,857,583 | 1/1999 | Chantaca et al. | 206/564 |
| 5,887,749 | 3/1999 | Schommer et al. | 206/564 |

*Primary Examiner*—Paul T. Sewell
*Assistant Examiner*—Shian Luong
*Attorney, Agent, or Firm*—Carstens, Yee & Cahoon; Colin P. Cahoon

[57] ABSTRACT

An improved food container for packaging a chip and dip product and providing a tray for holding the chip and dip product while it is consumed. The tray design nests a bag of chips or like product with a cup of dip or like product in a single contiguous compartment designed for vertical display.

4 Claims, 4 Drawing Sheets

FIG. 2
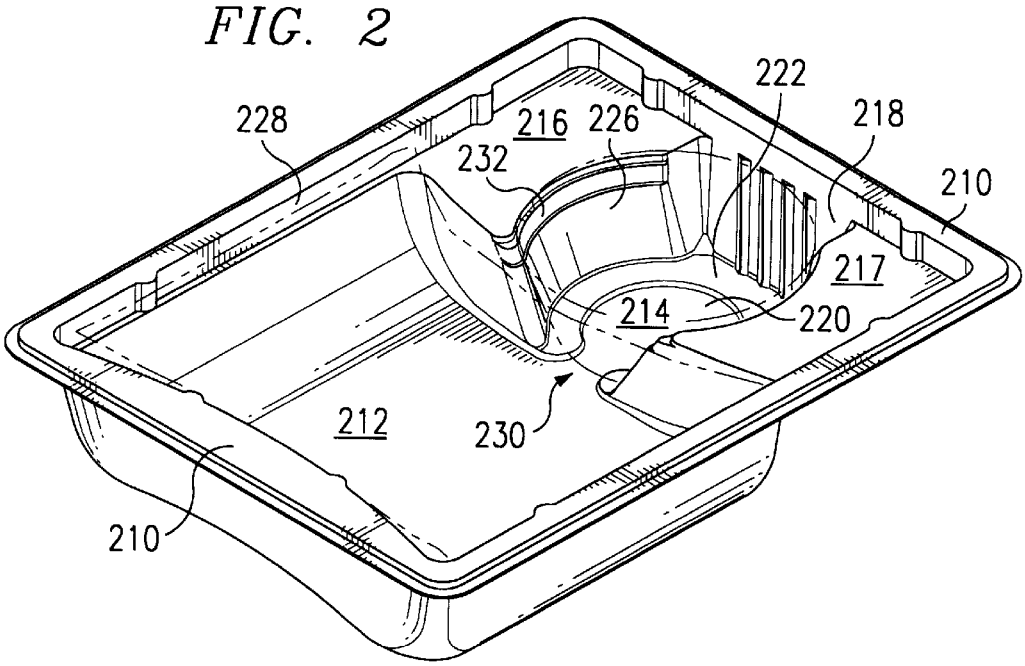
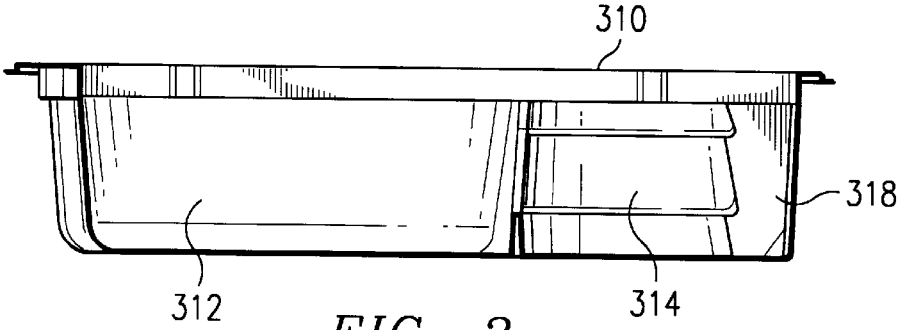
FIG. 3
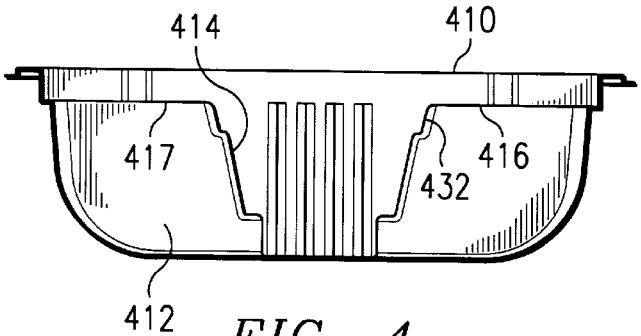
FIG. 4

CHIP AND DIP TRAY

BACKGROUND OF THE INVENTION

1. Technical Field

The present invention relates to a food container, and in particular to a chip and dip tray suitable for vertical display in a retail environment, that contains a chip product in a bag and a dip product in a cup or can nested in a form-fit tray. The tray is sealed with a cover and serves the dual function of packaging the product and acting as a convenient serving container for the product during consumption of the product.

2. Description of Related Art

Various container and package designs have been used in the past to contain and display food products. For example, U.S. Pat. No. 5,657,874, Hustad et al., describes a rigid plastic base tray having at least three compartments covered with a flexible film that hermetically seals each of the compartments. U.S. Pat. No. 5,853,105, Roman et al., discloses a circular container comprised of two compartments hermetically sealed by a film placed over the top of the two compartments. U.S. Pat. No. 5,277,920, Weaver, Jr., discloses a food package consistent of two separate compartments covered by sealing means.

None of the prior art, however, teaches a food container that efficiently packages a bag of chips or like product with a cup or can of dip or like product that can both provide a vertical display, retail packaging function and act as a tray for use by the consumer after the product is opened. None of the prior art containers would be suitable for use with a bag of chips and a cup of dip and presenting this combination in a package arrangement that takes advantage of the inherent shape of the bag and cup to provide a functional tray and efficient package design.

Accordingly, a need exists for a chip and dip tray container designed to contain a bag of chips or like product and a cup of dip or like product utilizing a design that takes advantage of the geometry of the bag and the cup. The container should be as compact as possible yet provide for a vertical display when propped on one end. Such container should also serve as a functional tray in which the chips can be poured into and the dip cup nested while the product is being consumed after the container has been opened. Ideally, the chip and dip tray design should be suitable for containing standard size food packages, thus requiring a minimal amount of dedicated manufacturing resources and maximum operational flexibility.

SUMMARY OF THE INVENTION

The proposed invention comprises a chip and dip container/tray having a generally rectangular edge around an opening. This opening is an hourglass shaped, rounded depression at one end (in which is inserted a bag of chips or like product) and is a circular cup well at the other end (which holds a cup of dip or like product that nests with the bag of chips). The opening is then sealed. A hermetic seal is not required, however, because the chips and the dip are contained in separate individual packages. The container further comprises a flat protrusion extending from the cup well which acts as a pedestal permitting the container to be placed on one end for vertical display purposes.

When the seal on the container opening is removed, the bag of chips can be taken out, opened, and the chips emptied into the hourglass shaped portion of the container. The top of the cup can be removed and the cup placed back in the cup well. In this configuration, the container now becomes a convenient tray for holding the chips and dip while they are being consumed.

The container design takes advantage of the geometries of a bag of chips and a cup of dip in order to minimize the overall dimensions of the container. This in turn reduces the shipping and material costs for each container. At the same time, the tray is uniquely suited for holding loose chips and an open cup, thus serving as an eating tray while the product is being consumed. The container's ability to contain a standard bag of chips and dip cup provides maximum operational flexibility while minimizing the need for special packaging equipment.

The above as well as additional features and advantages of the present invention will become apparent in the following written detailed description.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

FIG. 2 is a perspective view of a second embodiment of the invention;

FIG. 3 is a cut away of the first embodiment of the invention along the reference numbers "3" on FIG. 1*a;*

FIG. 4 is cut away of the first embodiment of the invention along the reference numbers "4" on FIG. 1*a;*

DETAILED DESCRIPTION

Figure 1A:
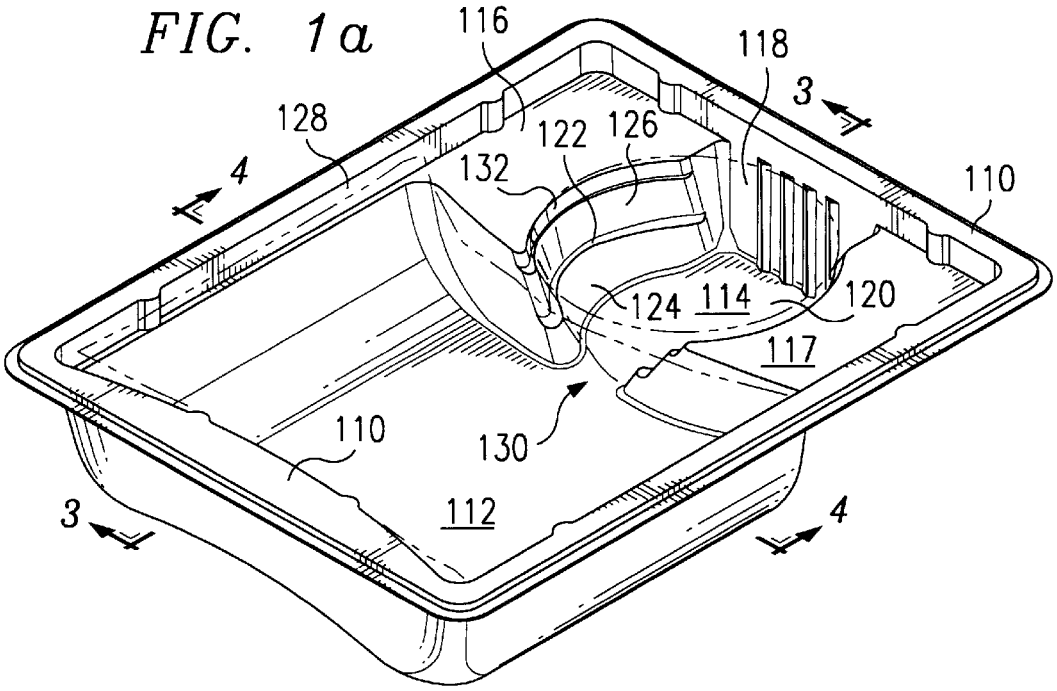
FIGS. 1*a* through 1*d* are perspective views of a first embodiment of the invention.

FIGS. 1*a*, 1*b*, 1*c*, and 1*d* illustrate a first embodiment of the invention all from the same perspective showing the chip and dip tray empty, filled with a chip bag and dip cup, filled and sealed, and used in the tray configuration with chips poured out of the bag and the dip cup opened, respectively. The overall tray shown in FIG. 1*a* is one contiguous piece formed preferably out of a plastic material. For example, the tray can be manufactured by thermoforming polypropylene. Thermoforming is a process whereby a semi-molten or soft sheet of plastic is pulled over a forming cavity. A vacuum is then applied to pull the sheet into the cavity in combination with a plug assisting to press the sheet into the cavity, thereby forming the plastic into the shape of the forming cavity.

Figure 1B:
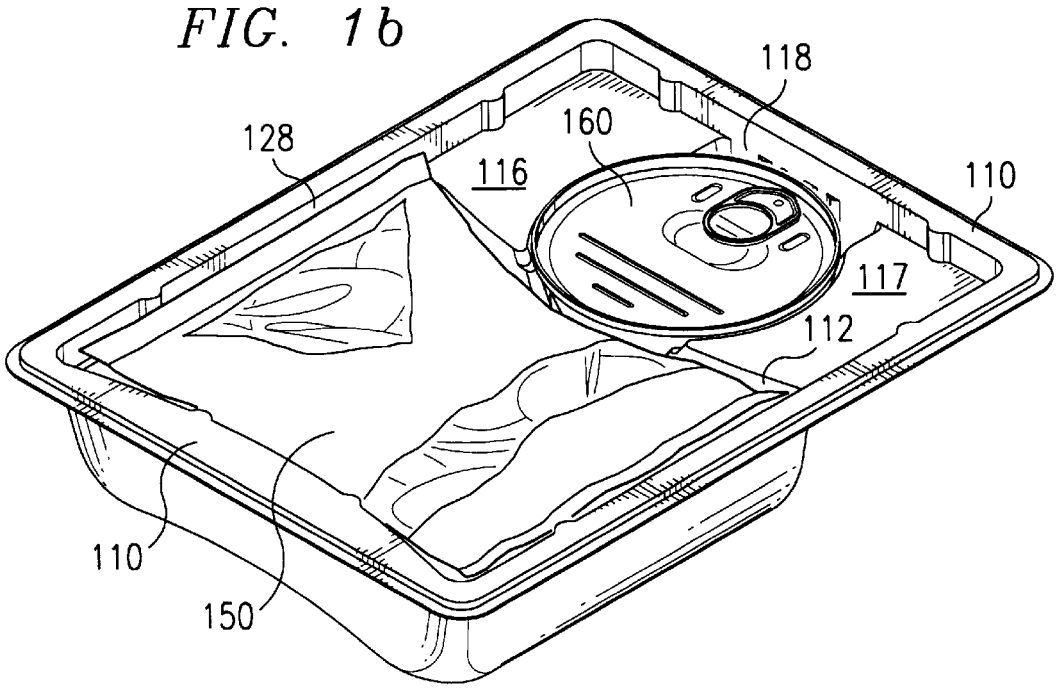

As shown in FIG. 1*a*, the invention has a generally rectangular edge 110 that frames the interior opening of the container. This interior opening comprises a bag cavity 112 for holding a bag of chips or like product, a cup well 114 for holding a cup or can of dip or like product, and two flat wing platforms 116, 117. The bag cavity 112 has an hourglass shape when viewed from the opening of the container but a rounded shape when viewed from the end of the container, as is most evident in FIG. 4 (reference 412). This particular design allows for a snug, form fit to a bag of chips 150 nested in the bag cavity 112 as can be seen in FIG. 1*b*.

Returning to FIG. 1*a*, it is evident that the cup well 114 has a common opening onto the bag cavity 112. This feature takes advantage of the curved protrusion of the side of the cup 160 which nests with the curved depression of the side of a bag of chips 150, as seen in FIG. 1*b*. This feature, in combination with other cup well 114 features described further below also allows for the easy removal of the cup 160 from the container.

Figure 5:
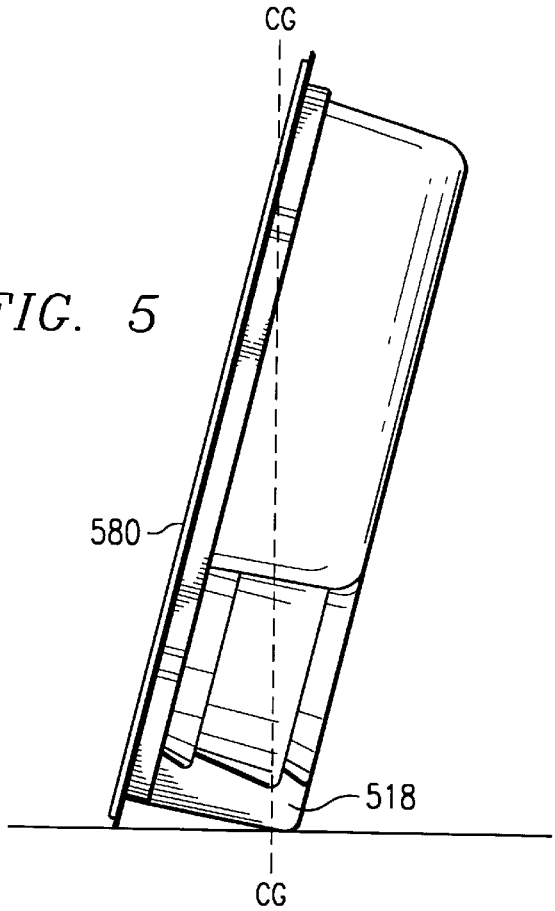
FIG. 5 is a side view of one embodiment of the invention positioned on one end as on vertical display; and, FIG. 6 is a perspective view of a third embodiment of the invention.

Protruding from the cup well 114 is a pedestal 118. As is illustrated by FIG. 5, this pedestal 518 provides support for the container when standing on its edge in a vertical display configuration. As shown in FIG. 1*a*, pedestal can be designed to incorporate a corrugated surface to add to its strength.

The embodiment illustrated in FIG. 1*a* shows additional features to the cup well 114 giving the container the flexibility of holding cups of varying dimensions. Specifically, there is a floor 120 to the cup well 114, a semi-circular rise 122, a semi-circular rise wall 124, and a semi-circular well wall 126. These features can accommodate both a narrow, tall cup and a wider, shorter cup. For example, a narrow, tall cup would rest on the cup well 114 floor 120 and be constricted by rise wall 124. The lip of the cup would extend above the level of the two wing platforms 116, 117, but there would be a cavity between the cup and the well wall 126. Conversely, a shorter, wider cup would rest on the rise 122 and be constricted by the well wall 126. In the example of the shorter, wider cup, there would be a cavity between the base of the cup and the cup well floor 120. Whether using a short, wide cup or a narrow, tall cup, easy access is provided by virtue of a channel 130 between the bag well and the cup cavity 114 along the level of the floor 120.

Another feature shown is a cup lid accommodation 132, which allows space for an over-cap type lid. Also shown in FIG. 1*a* is a short, vertical wall 128 which provides the limited head space required to allow for the protrusion of the over-cap of a cup above the wing platforms 116, 117.

FIG. 2 shows a second embodiment of the invention designed to accommodate a single size cup. This involves a slightly different design to the cup well 214. Specifically, the rise 222 is flatter and in a horseshoe shape. The open end of the horseshoe shape rise 222 allows for a channel 230 leading from the bag cavity 212 to the floor 220 of the cup well 214. This channel 230 makes it easier for the consumer to insert a finger underneath the cup to remove it from the cup well 214. While contained in the cup well 214, the cup fits against the cup well wall 226. Again, there is a cup lid accommodation 232. The short vertical wall 228 allows for the protrusion of the over-cap of a cup above the wing platforms 216, 217. The cup well 214 incorporates a similar pedestal 218 design. As with the first embodiment, the second embodiment also comprises a generally rectangular edge 210 about the periphery of the container and several other common features.

Referring now to FIG. 1*b*, when packaging a product in the container, first a bag 150 of chips or like product is placed in the bag cavity 112. Next, a cup or can 160 of dip or like product is placed in the cup well 114. Again, it should be noted how the rounded and sloping surface of the side of the cup 160 nests with the curved depression naturally formed on the side of the bag 150. The dimensions of the bag 150 and the cup 160 govern the overall dimensions of the container. For example, for use as a chili and chip container, a six ounce cup of chili nested with a three and a half ounce bag of Frito-Lay's Fritos™ Scoops™ Corn Chips has been found to work well in a container having a width of about seven inches, a length of about nine and a half inches, and a depth of about two and a half inches. Another example of a smaller container size using the dual purpose cup well 114 design of FIG. 1*a* is particularly suited for holding a one and seven eighths ounce bag of bite size Tostitos™ Tortilla Chips along with either a wide and short 4.2 ounce cup of dip or a narrow and tall 3.8 ounce cup of salsa. Appropriate dimensions for this smaller container are a width of about seven inches, length of about nine inches, and depth of about two and one eighth inches.

Figure 1C:
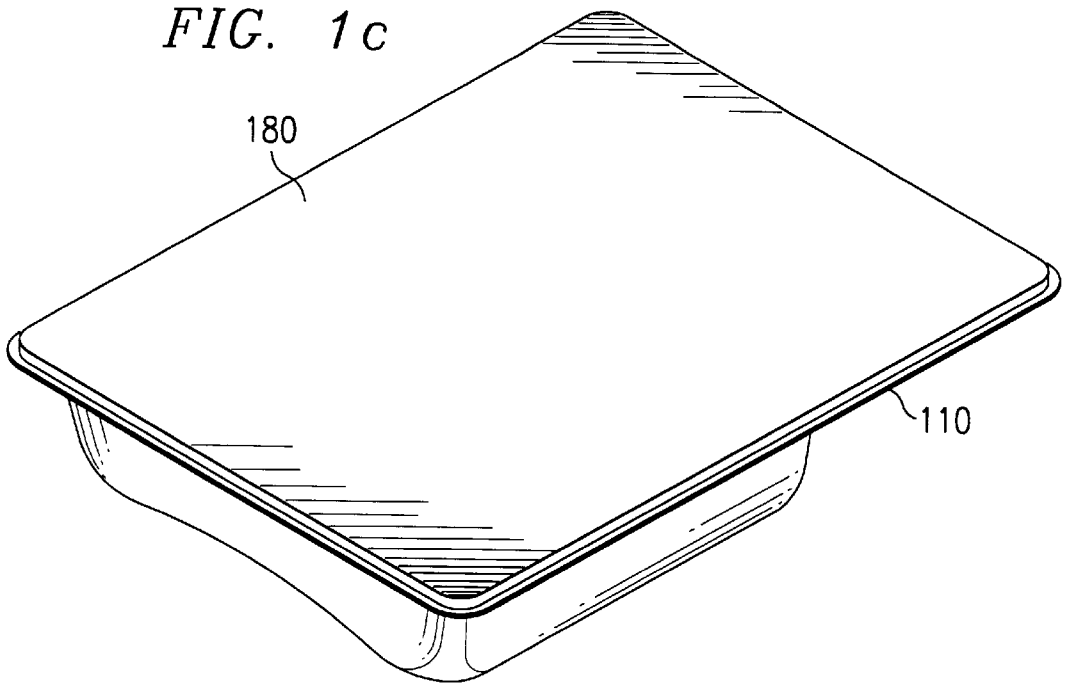

Once the bag 150 and cup 160 have been placed in the container, an opaque cover shown in FIG. 1*c*, is placed over the top of the container, sealing and attaching to the container at the rectangular edge 110. It is not necessary to hermetically seal the container, since both the chip product and the dip product are already individually contained and the individual packaging for the chip product and the dip product provides the relevant barrier properties to protect the product within. One suitable embodiment of the cover 180 is a lamination consisting of a print carrier laminated to a sealant film attached by heat and pressure seal to the edge 110 of the container. This cover 180 serves as a carrier for marketing information and is prominent when the container is in the vertical display mode as illustrated in FIG. 5. Although FIG. 5 shows the side view, it is anticipated that the container would be displayed in a retail setting with the cover 580 facing the consumer.

Figure 1D:
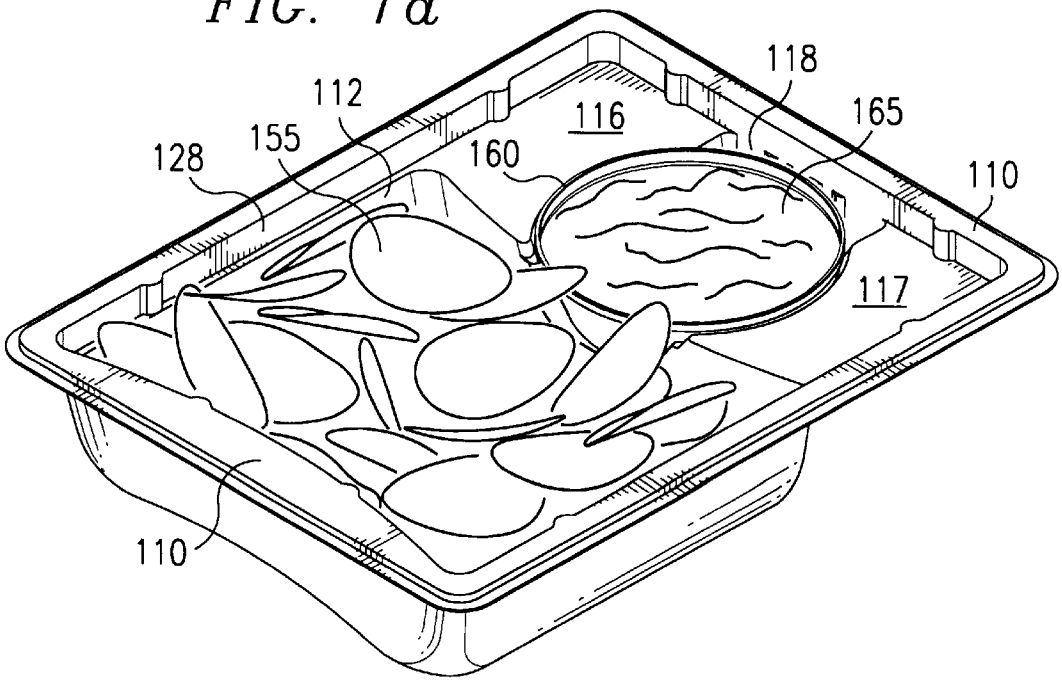

Now with reference to FIG. 1*d*, it can be seen that the container serves also as a convenient tray to be used while the product is consumed. To consume the product, first the cover 180 is removed and discarded. The bag 150 is then removed and opened. The contents of the bag, such as chips 155, can the be poured into the bag cavity 112. The cup 160 is also easily removed by inserting the finger through the rise channel 130 and into the cavity created by the rise 122 in the embodiment's involving cups that rest on the rise 122. If the container holds a narrower cup 160 that rests on the floor 120 of the cup well 114, then the cup 160 is easily removed by inserting the fingers around the cup 160 because of the cavity between the cup 160 and the cup well side wall 126. The cup's lid can then be opened in order to access the dip or like product 165 contained therein.

The cup 160 can be microwavable when the dip 165 requires heating for optimal eating characteristics, such as with a cheese dip product or chili product. In such instance, the cup 160 is microwaved and then returned to the cup well 114. Once the cup 160 has been replaced in the cup well 114, the consumer can easily access the loose chips 155 from the bag cavity 112 and dip them in the open cup resting in the cup well 114. Further, the wing platforms 116, 117 provide convenient handles for holding the container between the thumb and fingers. The wing platforms 116, 117 can also be embossed with marketing information so that the tray can be identified to the product consumed even after the cover 180 has been discarded.

FIG. 3 shows a cut away view of the first embodiment of the container, along the reference numbers "3" on FIG. 1*a*, further illustrating some of the geometries of the design. The generally rectangular edge 310 is shown in profile. Also shown is the exterior surfaces defining the bag cavity 312, the cup well 314, and the pedestal 318.

FIG. 4 is a cut away of the first embodiment of the container along the reference numbers "4" on FIG. 1*a*. Again, the generally rectangular edge 410 is shown in profile. Also shown in profile is the under-side of the two wing platforms 416, 417. The general exterior shape of the cup cavity 414 is illustrated, prominent of which is the cup lid accommodation 432. The generally curved shape of the bottom portion of the bag cavity 412 can also be seen.

FIG. 5 further illustrates the center of gravity (CG) design considerations of the container. By placing the heavier cup at the base end of the container near the pedestal 518 and the lighter bag at the upper end of the container, the center of gravity of the overall container is such that the container will exhibit adequate stability to be placed on one edge in a vertical display, as shown in FIG. 5.

Figure 6:
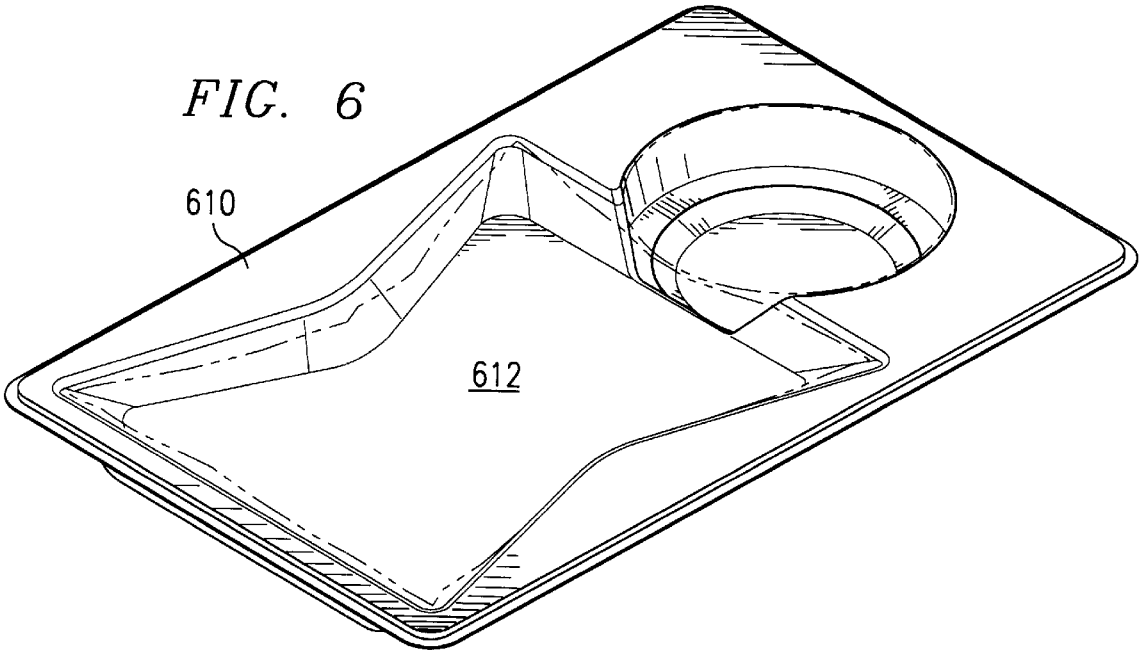

FIG. 6 illustrates a third embodiment of the invention wherein the bag cavity 612 is re-oriented ninety degrees so that the cup is ultimately nested with one edge of the chip bag, as opposed to the side of the chip bag as shown in the first embodiment illustrated in FIG. 1*a*.

While the invention has been particularly shown and described with reference to a preferred embodiment, it will be understood by those skilled in the art that various changes in form and detail may be made therein without departing from the spirit and scope of the invention.

What is claimed is:

1. A container for food products comprising:

a first compartment having a first floor;

a first wall having a first end and a second end, wherein said first wall extends upward from a periphery of said first floor and wherein said first wall is shaped to hold a bag of chips;

a second compartment having a second floor joined on one side to said first floor;

a partially-circular wall having a first end connected to said first end of said first wall and a second end connected to said second end of said first wall such that a continuous wall is formed, wherein said partially-circular wall extends upward from a periphery of said second floor such that said second compartment is suitable for holding a cup; and a third floor attached to a top of said continuous wall extending outwardly from said contiguous wall to a generally rectangular edge, wherein said first compartment and said second compartment are contiguous, such that a bag held in said first compartment may nest with a cup held in said second compartment.

2. The container of claim 1 further comprising:

a pedestal protruding from said second compartment suitable for supporting said container when set on an edge of said container for a vertical display.

3. The container of claim 1 further comprising:

a cover covering said first compartment and said second compartment attached to said generally rectangular edge.

4. A container with food products comprising:

a first compartment having a first floor;

a first wall having a first end and a second end, wherein said first wall extends upward from a periphery of said first floor and wherein said first wall is shaped to hold a bag of chips;

a second compartment having a second floor joined on one side to said first floor;

a partially-circular wall having a first end connected to said first end of said first wall and a second end connected to said second end of said first wall such that a continuous wall is formed, wherein said partially-circular wall extends upward from a periphery of said second floor such that said second compartment is suitable for holding a cup; and a third floor attached to a top of said continuous wall extending outwardly from said continuous wall to a generally rectangular edge, wherein said first compartment and said second compartment are contiguous, such that a bag held in said first compartment may nest with a cup held in said second compartment;

a sealed bag placed in said first compartment;

a sealed cup placed in said second compartment; and a cover covering said first compartment and said second compartment attached to said generally rectangular edge.

* * * * *